United States Patent [19]

McGeehin et al.

[11] 4,047,634

[45] Sept. 13, 1977

[54] LID HAVING A SEPARABLE PANEL

[76] Inventors: Robert McGeehin, 36 Newlaithes Gardens, Horsforth, Leeds LS18 4JU; Edward Dodswoth, 1 Grampian Close, Shelly, near Huddersfield, both of England

[21] Appl. No.: 660,019

[22] Filed: Feb. 23, 1976

Related U.S. Application Data

[62] Division of Ser. No. 498,714, Aug. 19, 1974, abandoned.

[30] Foreign Application Priority Data

Aug. 21, 1973 United Kingdom ..... 39455/73

[51] Int. Cl.[2] ..... B65D 41/32

[52] U.S. Cl. ..... 220/270; 220/277

[58] Field of Search ..... 220/270–273, 220/267, 277

[56] References Cited

U.S. PATENT DOCUMENTS

| | | | |
|---|---|---|---|
| 3,768,692 | 10/1973 | Saunders | 220/273 |
| 3,857,166 | 12/1974 | Gaillard | 220/273 X |

*Primary Examiner*—George T. Hall

*Attorney, Agent, or Firm*—Wolf, Greenfield & Sacks

[57] ABSTRACT

The invention resides in a lid for containers of the type having a pull tab attached to a separable panel on the lid. The lid is weakened along a line to define the panel which can be removed or bent to give access to the contents of the container. The panel has a well over which the pull tab extends to enable the tab to be lifted by a finger inserted in the well. The panel has a raised horseshoe shaped portion near the line of weakening. The bight of the horseshoe forms part of the well's perimeter and the end of the tab to be lifted is disposed between the legs of the horseshoe. Upon lifting of the tab end, the opposite end of the tab initiates fracture of the panel along the weakened line.

2 Claims, 2 Drawing Figures

LID HAVING A SEPARABLE PANEL

This application is a division of our co-pending application Ser. No. 498,714, filed Aug. 19, 1974; now abandoned.

This invention relates in general to easily openable plastics containers of the type having a pull tab for facilitating rupture of a panel which can be removed or swung out of the way.

BACKGROUND OF THE INVENTION

Today, plastics material containers which are thermoformed from sheet material are in extensive use for containing foodstuffs such as cream, yoghurt, mousse, ice cream and so on. These containers always have lids but, generally speaking the plastics containers are lidded either with metallic foil or waxed cardboard. The utilization of different materials for the lid and the container is an inconvenience because this usually involves two suppliers.

Many difficulties are experienced in applying metal lids, metallic foil, or waxed cardboard to serve as closures for plastics material containers. For example, heavy sealing forces need to be applied in the case of metal lids and such forces can lead to distortion of the plastics material of the plastics container which in turn can lead to leakage of the contents of the container after the sealing thereof.

Where metal foil is used to seal the container, this suffers from the disadvantage that invariably an adhesive must be used or the metal foil must be pre-coated with a material which will seal to the flange of the container. In any event, metal foil has limited strength to such an extent that a container sealed thereby is not suitable for holding, for example, carbonated beverages. The waxed cardboard lids for these containers suffer from the same disadvantages as the foil lids, and have the additional disadvantage that cardboard is highly permeable to liquids and gases, hence the reason for the wax coatings, and furthermore the step of having to apply the wax coating makes the manufacture of cardboard lids expensive.

SUMMARY OF THE INVENTION

The invention resides in a plastics lid that can readily be sealed to the plastics container. The lid has a pull tab for facilitating the fracture of a panel in the lid along a weakened line. When fractured along the line, the panel may be removed or bent back to give access to the interior of the container. The panel has a raised horseshoe shaped portion near the line of weakening. The bight of the horseshoe forms part of the perimeter of a well in the panel. The pull tab extends over the well and between the legs of the horseshoe whereby when that end of the tab is lifted by a finger inserted in the well, fracture of the panel is initiated at the other end of the tab.

DESCRIPTION OF THE PREFERRED EMBODIMENT

Figure 1:
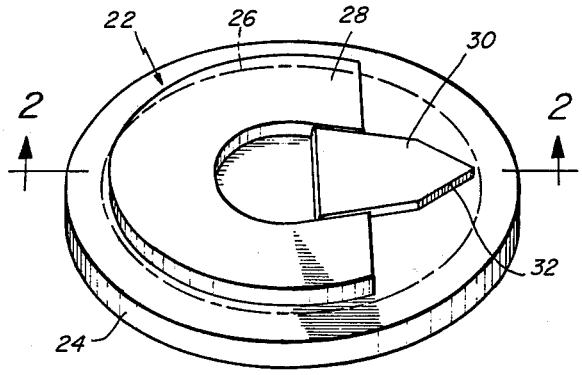
FIG. 1 depicts a perspective view of the preferred embodiment of the invention in perspective.
Figure 2:
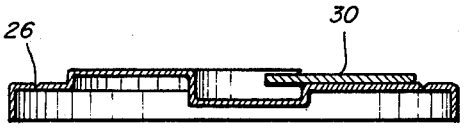
FIG. 2 is a side elevational view of the preferred embodiment.

In FIGS. 1 and 2, of the drawings there is shown a generally circular lid 22 for an appropriately shaped circular sectioned container (not shown). The lid basically comprises a top and a downwardly directed peripheral flange 24. The lid is thermoformed in synthetic plastic material from sheet stock.

In the top of the lid there is provided a line of weakening 26 which is preferably formed by a groove providing a reduced thickness along the line 26.

The line of weakening 26 is circular and is concentric with the circular form of the lid 22. Within the region defined by the line 26 there is moulded a raised horseshoe portion 28 the centre of which lies approximately centrally of the lid 22. A snap tab 30 is attached to the top of the lid 22 within the region defined by line 26. One end of the tab 30 lies between the arms of the horseshoe formation 28 and extends over a well 23 whereby a finger can be slipped under the tab end. The tab 30 has a pointed end 32 lying adjacent the line 26, and upon lifting of the tab end, the tab pivots and acts as a lever to enable an initial fracture in the line 26 to be made adjacent the point whereby the whole of the section within line 26 can subsequently be removed. The tab 30 is secured to the lid 22 by any suitable means such as adhesive or ultrasonic welding or a combination of such means.

The described lid is thermoformed, i.e. heated and then formed by means of vacuum, fluid under pressure (with or without plug assist) or mechanical forming or a combination of these methods, and after the formation of the lid the line of weakening subsequently is put into the lid top, the tab 30 is then attached and the lid is removed from the sheet stock in which it is formed.

What we claim is:

1. In a lid for a container wherein the lid is of the type having 1. a line of weakening defining a panel that can be removed or bent to permit access to the interior of the container, and
2. a substantially rigid tab secured to the panel for causing fracture along a portion of the line of weakening by lifting one end of the tab, the improvement for facilitating lifting of the tab and fracture along the remaining extent of the line of weakening comprising a. a well in the panel, one end of the rigid tab protruding over the well whereby the tab end can be lifted by a finger inserted in the well, and b. the panel including a raised horseshoe shaped portion whose outer periphery is adjacent to the line of weakening, the end of the tab to be lifted being disposed between the legs of the horseshoe, and the bight of the horseshoe forming a portion of the well perimeter.

2. The improvement according to claim 1 wherein the tab, in its initial state, does not extend above the topmost level of the raised horseshoe portion.

* * * * *